US010985468B2

(12) United States Patent
Baldauf et al.

(10) Patent No.: US 10,985,468 B2
(45) Date of Patent: Apr. 20, 2021

(54) HALF-PATCH LAUNCHER TO PROVIDE A SIGNAL TO A WAVEGUIDE

(71) Applicant: THE BOEING COMPANY, Chicago, IL (US)

(72) Inventors: John E. Baldauf, Redondo Beach, CA (US); James M. Barker, Torrance, CA (US); Enrique M. Alvelo, Los Angeles, CA (US); William J. Ceely, Fontana, CA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/508,064

(22) Filed: Jul. 10, 2019

(65) Prior Publication Data

US 2021/0013612 A1 Jan. 14, 2021

(51) Int. Cl.

| | |
|---|---|
| ***H01Q 9/04*** | (2006.01) |
| ***H01Q 5/55*** | (2015.01) |
| ***H01Q 1/48*** | (2006.01) |
| ***H01Q 1/52*** | (2006.01) |
| ***H01Q 9/06*** | (2006.01) |

(52) U.S. Cl.

CPC ..... *H01Q 9/0421* (2013.01); *H01Q 1/48* (2013.01); *H01Q 1/526* (2013.01); *H01Q 5/55* (2015.01); *H01Q 9/0407* (2013.01); *H01Q 9/0471* (2013.01); *H01Q 9/065* (2013.01)

(58) Field of Classification Search

CPC ..... H01Q 9/0421; H01Q 1/48; H01Q 1/526; H01Q 9/0471; H01Q 13/206; H01Q 13/106; H01Q 5/55; H01Q 9/0407; H01Q 9/0485; H01Q 9/065; H01Q 21/065; H01Q 1/38; H01P 3/12; H01P 5/103; H01P 5/107; H01P 5/181; H01P 5/1007

See application file for complete search history.

(56) References Cited

U.S. PATENT DOCUMENTS 4,228,411 A * 10/1980 Harrison ..... H03B 19/18 333/218
5,793,263 A * 8/1998 Pozar ..... H01P 5/107 333/26

(Continued)

FOREIGN PATENT DOCUMENTS

WO 2009055895 A1 5/2009

OTHER PUBLICATIONS

Buoli, C. et al., "A broadband microstrip to waveguide transition for FR4 multilayer PCBs up to 50 GHz.," 2002 32nd European Microwave Conference, Sep. 2002, 4 pages.

(Continued)

*Primary Examiner* — Vibol Tan
(74) *Attorney, Agent, or Firm* — Moore IP Law

(57) ABSTRACT

An apparatus includes a first conductive patch coupled to a first surface of a dielectric layer, a second conductive patch coupled to a second surface of the dielectric layer, and a probe coupled to the second conductive patch. The apparatus further includes a waveguide having a wall conductively coupled to the first conductive patch. Responsive to a signal provided to the second conductive patch by the probe, interaction of the waveguide, the first conductive patch, and the second conductive patch generates a transmission signal that propagates in the waveguide.

20 Claims, 14 Drawing Sheets

(56) References Cited

U.S. PATENT DOCUMENTS

| | | | | |
|---|---|---|---|---|
| 5,942,944 | A | 8/1999 | Paolella et al. | |
| 6,242,984 | B1 | 6/2001 | Stones et al. | |
| 6,639,484 | B2 * | 10/2003 | Tzuang | H01P 1/2088 333/21 R |
| 6,822,528 | B2 * | 11/2004 | Dawn | H01P 5/107 333/26 |
| 7,486,234 | B2 * | 2/2009 | Watts | H01Q 9/0407 343/700 MS |
| 7,889,129 | B2 | 2/2011 | Fox et al. | |
| 9,019,375 | B1 | 4/2015 | Whelan et al. | |
| 9,065,163 | B1 | 6/2015 | Wu et al. | |
| 9,325,050 | B2 | 4/2016 | Gao et al. | |
| 9,608,313 | B2 | 3/2017 | Kim et al. | |
| 10,168,429 | B2 | 1/2019 | Maleki et al. | |
| 10,566,672 | B2 * | 2/2020 | Elsherbini | H01P 5/107 |
| 2003/0197572 | A1 | 10/2003 | Ammar | |
| 2007/0085626 | A1 | 4/2007 | Lee et al. | |
| 2010/0090903 | A1 * | 4/2010 | Byun | H01Q 13/18 343/700 MS |
| 2010/0225410 | A1 | 9/2010 | Margomenos et al. | |
| 2011/0068990 | A1 * | 3/2011 | Grzyb | H01P 5/00 343/772 |
| 2019/0207287 | A1 | 7/2019 | Dogiamis et al. | |

OTHER PUBLICATIONS

Elsässer, M. et al., "Development of a Simple Broadband Microstrip to Waveguide Transition," 2017 International Conference on Electromagnetics in Advanced Applications (ICEAA), pp. 1700-1703.

Iizuka, H. et al., "Millimeter-Wave Transition From Waveguide to Two Microstrip Lines Using Rectangular Patch Element," IEEE MTT-S, vol. 55, No. 5, May 2007, pp. 899-905.

Lee, H. Y. et al., "Wideband Aperture Coupled Stacked Patch Type Microstrip to Waveguide Transition for V-band," Proceedings of Asia-Pacific Microwave Conference 2006, pp. 360-362.

Simeoni, M. et al., "Patch End-Launchers—A Family of Compact Colinear Coaxial-to-Rectangular Waveguide Transitions," IEEE MTT-S, vol. 54, No. 4, Apr. 2006.

Topak, E. et al., "Compact Topside Millimeter-Wave Waveguide-to-Microstrip Transitions," IEEE Microwave and Wireless Components Letters, vol. 23, No. 12, Dec. 2013, pp. 641-643.

U.S. Appl. No. 16/508,064 dated Jul. 10, 2019, John E. Baldauf.

U.S. Appl. No. 16/508,110 dated Jul. 10, 2019, John E. Baldauf.

* cited by examiner

HALF-PATCH LAUNCHER TO PROVIDE A SIGNAL TO A WAVEGUIDE

FIELD

The present disclosure is generally related to electronic devices and more specifically to electronic devices that transmit and receive signals using waveguides.

BACKGROUND

Electronic devices can include components mounted on a substrate, such as a printed circuit board. In some electronic devices, a printed circuit board provides a signal from one component to a waveguide for transmission to another component. In some devices, the signal is amplified using an amplifier prior to transmission using the waveguide.

In some cases, operation of an amplifier is constrained by loss (e.g., thermal dissipation) associated with the amplifier or a maximum power capability of the amplifier. To reduce effects of loss or maximum power capability, some electronic devices split a signal into sub-signals (e.g., using a splitter circuit) and amplify the sub-signals using a plurality of amplifiers. The amplified sub-signals are then combined (e.g., using a combiner circuit) and transmitted using a waveguide.

In some designs, one or both of a splitter circuit or a combiner circuit are associated with power consumption, decreasing efficiency of a device. Further, a splitter circuit and the combiner circuit occupy area of the device, increasing device size or reducing area available to other components of the device.

SUMMARY

In a particular example, an apparatus includes a first conductive patch coupled to a first surface of a dielectric layer, a second conductive patch coupled to a second surface of the dielectric layer, and a probe coupled to the second conductive patch. The apparatus further includes a waveguide having a wall conductively coupled to the first conductive patch. Responsive to a signal provided to the second conductive patch by the probe, interaction of the waveguide, the first conductive patch, and the second conductive patch generates a transmission signal that propagates in the waveguide.

In another example, a method includes receiving, from a probe, a first signal at a second conductive patch coupled to a second surface of a dielectric layer. The method further includes generating, by a first conductive patch coupled to a first surface of the dielectric layer, a second signal based on the first signal. The method further includes generating, by a waveguide that includes a wall conductively coupled to the first conductive patch, a transmission signal that propagates in the waveguide. Responsive to the first signal provided to the second conductive patch by the probe, interaction of the waveguide, the first conductive patch, and the second conductive patch generates the transmission signal.

In another example, an apparatus includes a half-patch launcher including a first conductive patch coupled to a first surface of a dielectric layer and further including a second conductive patch coupled to a second surface of the dielectric layer. The apparatus further includes a probe coupled to the second conductive patch. The apparatus further includes a waveguide having a wall conductively coupled to the first conductive patch. Responsive to a signal provided to the second conductive patch by the probe, interaction of the waveguide, the first conductive patch, and the second conductive patch generates a transmission signal that propagates in the waveguide.

DETAILED DESCRIPTION

Figure 1A:
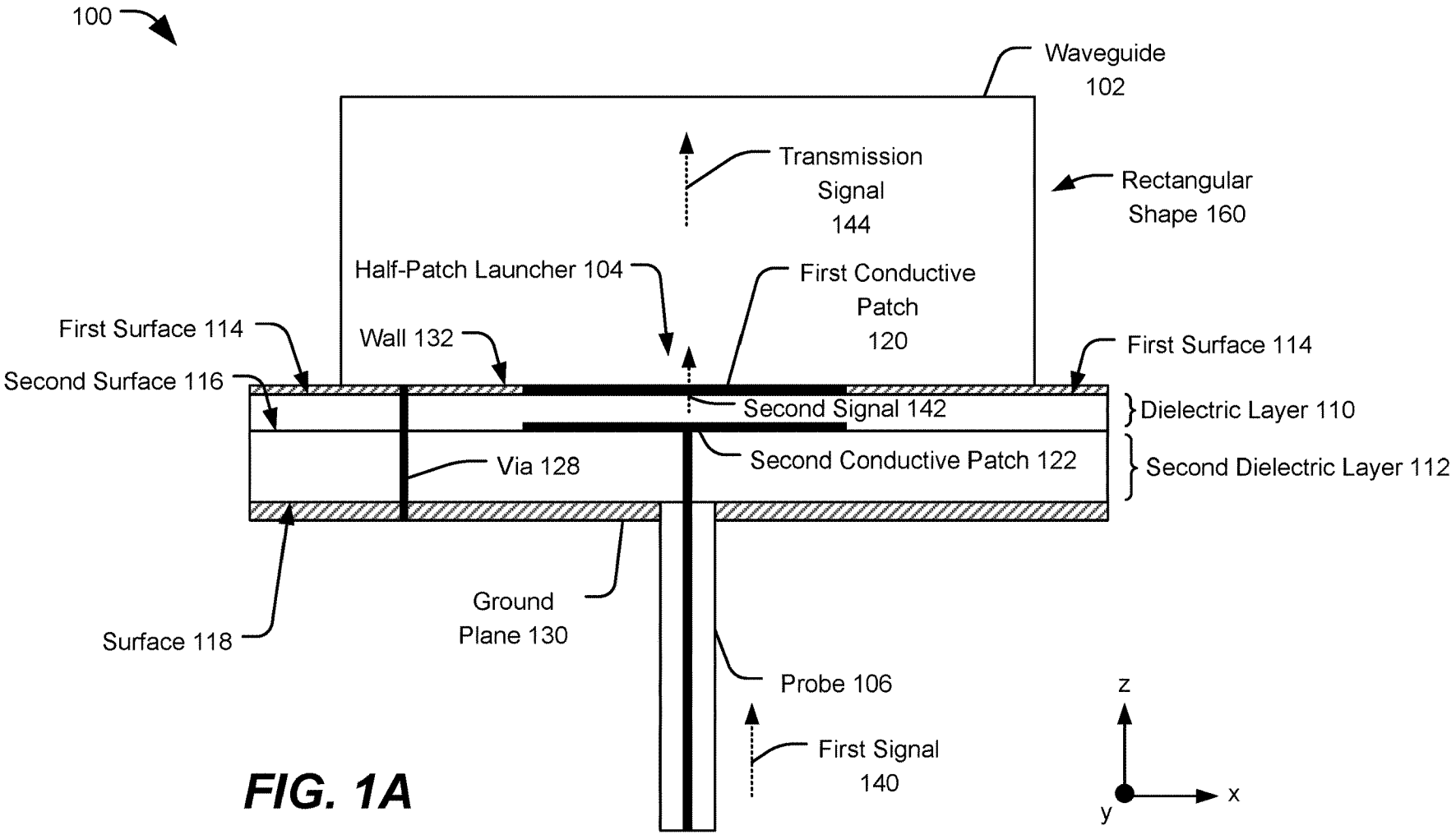
FIG. 1A is a diagram illustrating an example of a system in accordance with aspects of the disclosure.

In accordance with some aspects of the disclosure, systems are configured to generate signals for transmission via a waveguide while reducing or avoiding certain circuits included in some conventional devices. In at least one particular example, a system includes a half-patch launcher (e.g., a half-patch antenna) coupled to a waveguide. As used herein, a half-patch launcher (or a half-patch antenna) refers to an antenna (e.g., a microstrip antenna or another antenna) having a physical shorting connection (e.g., instead of a virtual shorting connection, as in certain full-patch antennas), a single radiation edge, a length that is one-quarter of a fundamental wavelength associated with the antenna, or a combination thereof.

The half-patch launcher includes a first conductive patch coupled to the waveguide and a second conductive patch that is configured to receive an input signal from a probe. In response to the input signal, interaction of the waveguide, the first conductive patch, and the second conductive patch generates a transmission signal in the waveguide.

In some examples, the half-patch launcher is grounded against a wall of the waveguide. Grounding of the half-patch launcher against the wall of the waveguide can increase system bandwidth, provide a discharge path for electrostatic discharge (ESD) events, or both. In a particular example, grounding of the half-patch launcher against the wall of the waveguide increases amplitude of the transmission signal, such as by enabling the transmission signal to appear as the full input signal (instead of half of the input signal). For example, in some implementations, the second conductive patch increases system bandwidth, and a ground plane functions as a reflector for a waveform to be transmitted via the waveguide. As a result, in some examples, a radiation pattern of the transmission signal is the sum of a signal provided to the waveguide by the half-patch launcher and a reflection of the signal (e.g., a virtual image of the signal). In some implementations, a single signal is provided to the half-patch launcher via a single probe, which can reduce device area and a number of device components as compared to a device that provides a differential signal to a full-patch launcher via multiple probes.

Alternatively or in addition, in another particular example, a system includes multiple launchers (e.g., multiple half-patch antennas), a waveguide, multiple amplifiers, and a signal splitter. The signal splitter is configured to split an input signal to generate two or more sub-signals, and the multiple amplifiers are configured to amplify the sub-signals to generate amplified signals that are provided to the multiple launchers. Interaction of the waveguide and the multiple launchers spatially combines the amplified signals to form a transmission signal within the waveguide. For example, in some implementations, the waveguide functions as a coherent combiner of the amplified signals, reducing or avoiding need for a separate combiner circuit between the amplifiers and the waveguide.

In some cases, a loss characteristic associated with the waveguide may be less than a loss characteristic associated with a combiner circuit. As a result, efficiency is increased by using a waveguide as a medium for coherent spatial combining of signals. Further, circuit area can be decreased by reducing or avoiding use of combiner circuits, decreasing device size or increasing area available to other device components.

Referring to FIG. 1A, a particular illustrative example of a system is depicted and generally designated 100. FIG. 1A includes a coordinate system indicating x, y, and z directions.

The system 100 includes a half-patch launcher 104 (e.g., a half-patch antenna). In the example of FIG. 1A, the half-patch launcher 104 includes a first conductive patch 120 and a second conductive patch 122. In some examples, the first conductive patch 120 is capacitively coupled to the second conductive patch 122. In such examples, the second conductive patch 122 is referred to as a driven patch, and the first conductive patch 120 is referred to as a parasitic patch (e.g., due to a capacitive or parasitic coupling between the first conductive patch 120 and the second conductive patch 122).

The first conductive patch 120 is coupled to a first surface 114 of a dielectric layer 110 of the system 100. The second conductive patch 122 is coupled to a second surface 116 of the dielectric layer 110. In some examples, the system 100 includes a second dielectric layer 112, and the second conductive patch 122 is between the dielectric layer 110 and the second dielectric layer 112. In some implementations, the system 100 includes a ground plane 130 coupled to a surface 118 of the second dielectric layer 112.

The system 100 also a waveguide 102 having a wall 132 conductively coupled to the first conductive patch 120. In some examples, one or both of the first conductive patch 120 and the second conductive patch 122 are grounded against the waveguide 102. For example, the wall 132 of the waveguide 102 can be connected to the ground plane 130, and the first conductive patch 120 can adjoin the wall 132. In some examples, the waveguide 102 corresponds to a rectangular waveguide having a rectangular shape 160. In other examples, the waveguide 102 has another shape, such as a cylindrical shape. In some examples, the system 100 is mounted to a printed circuit board (PCB) or a printed wiring board (PWB).

Figure 1B:
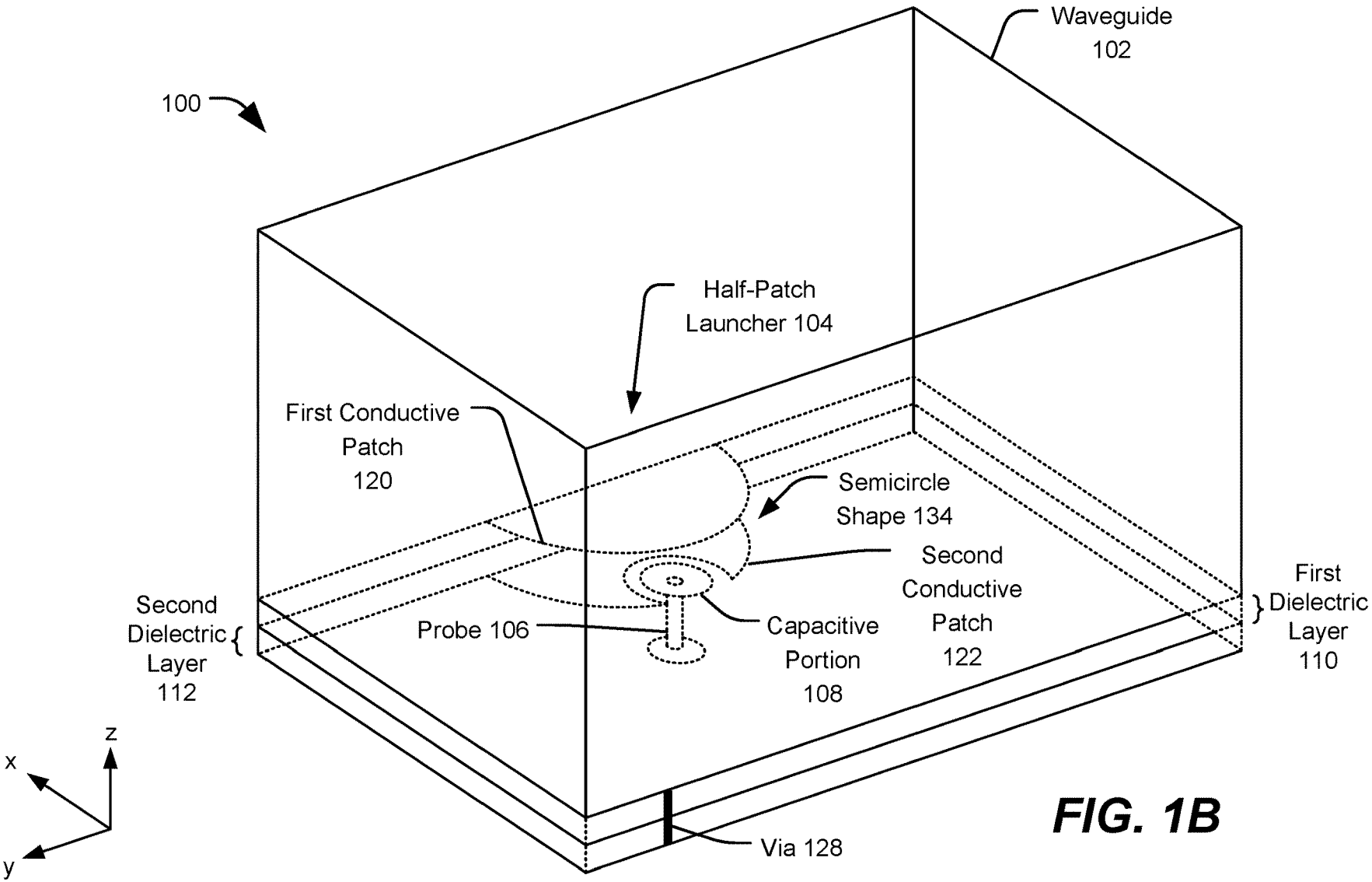
FIG. 1B is a diagram illustrating certain aspects of another example of the system of FIG. 1A.

In some examples, the system 100 further includes a plurality of vias extending through the ground plane 130 and the dielectric layers 110, 112. To illustrate, FIG. 1A depicts a via 128 extending through the ground plane 130 and the dielectric layers 110, 112. Although FIGS. 1A and 1B depict a single via 128 for convenience of illustration, it is noted that the system 100 can include a plurality of vias. In some examples, the plurality of vias defines a cavity (e.g., a rectangular cavity) in which the half-patch launcher 104 is formed, as illustrated more clearly in FIGS. 1C and 1D. In some examples, the via 128 includes a conductive material, such as one or more metals. It is noted that the particular arrangement and number of vias (such as the via 128) can be selected based on the particular application and can differ from the particular examples illustrated in the drawings, such as the particular example of FIG. 1A. It is also noted that the sizes of features depicted in the drawings are not necessarily drawn to scale and should not be construed as being limiting.

The system 100 further includes a probe 106 (e.g., a coaxial port) coupled to the second conductive patch 122. In some implementations, the probe 106 is directly coupled to the second conductive patch 122, such as where a conductive portion (e.g., a wire) of the probe 106 is in physical contact with the second conductive patch 122. In other implementations, the probe 106 is coupled to the second conductive patch 122 using another connection. For example, the probe 106 can be capacitively coupled to the second conductive patch 122, as described further with reference to the example of FIG. 1B.

In the example of FIG. 1B, the half-patch launcher 104 includes a capacitive portion 108 (e.g., a capacitor or a capacitive circuit that includes a capacitor). In this example, the probe 106 is capacitively coupled to the half-patch launcher 104 via the capacitive portion 108. In other examples, the half-patch launcher 104 can be coupled to the probe 106 using one or more other connections, such as a direct physical connection (e.g., using a wire). In a particular example, the probe 106 is associated with an inductance, and the capacitive portion 108 is configured to reduce an effect of the inductance associated with the probe 106 (e.g., by canceling or partially canceling impedance due to the inductance).

In FIG. 1B, the half-patch launcher 104 has a semicircle shape 134. In this example, the first conductive patch 120 and the second conductive patch 122 each include a patch having the semicircle shape 134. In other examples, the half-patch launcher 104 has another shape, such as a rectangular shape, as an illustrative example.

Figure 1C:
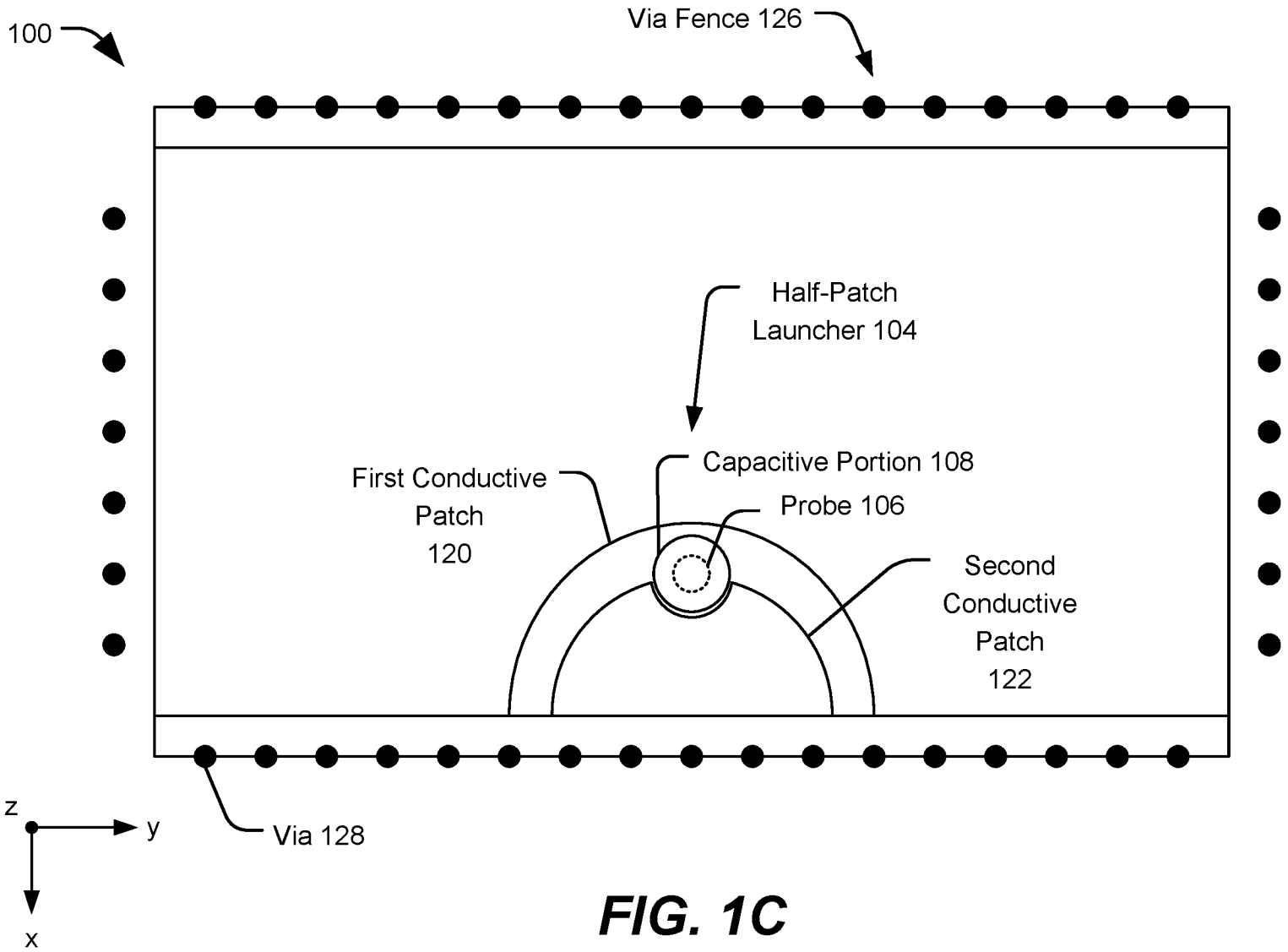
FIG. 1C is a diagram illustrating certain aspects of another example of the system of FIG. 1A.
Figure 1D:
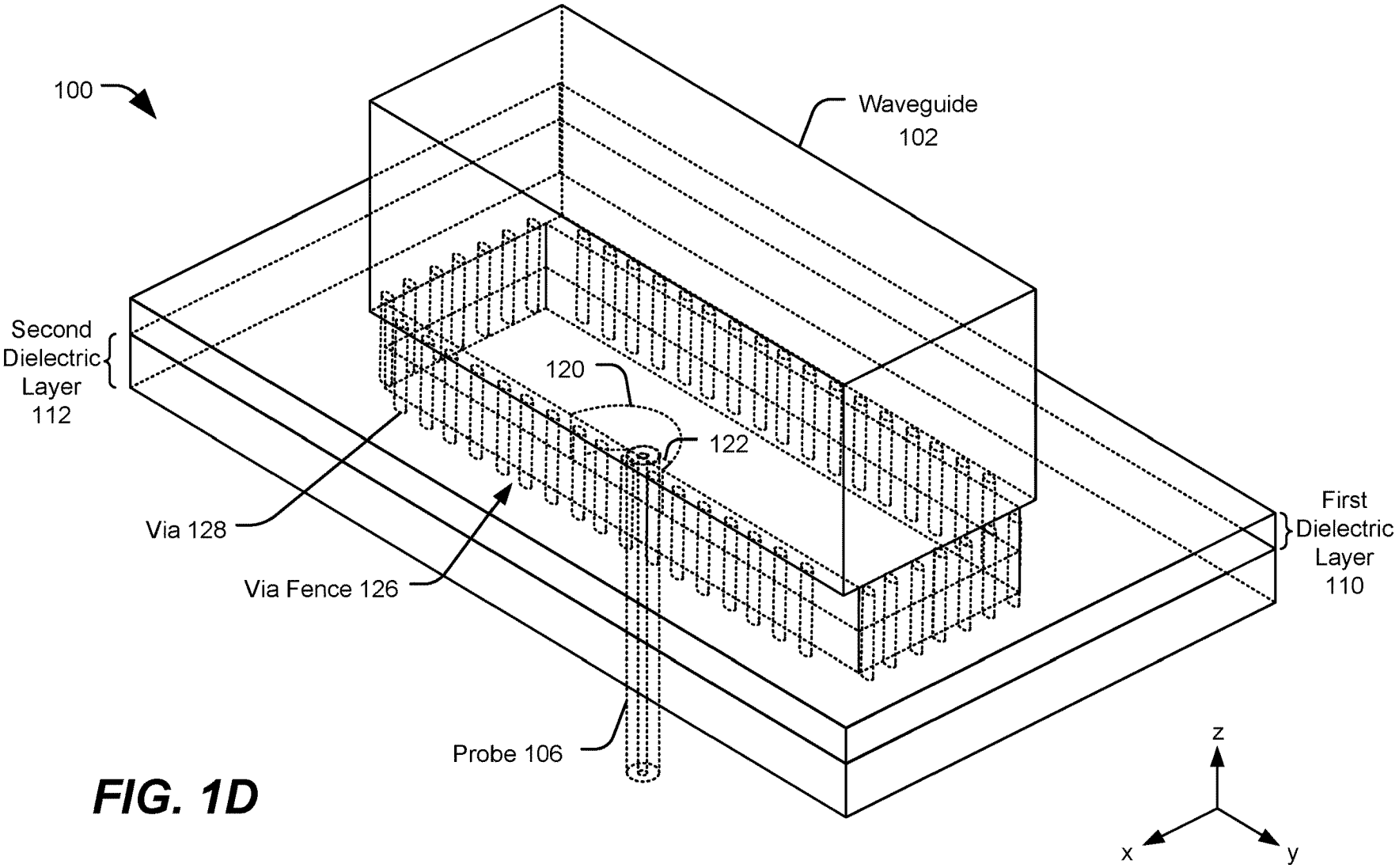
FIG. 1D is a diagram illustrating certain aspects of another example of the system of FIG. 1A.

FIGS. 1C and 1D depict another view of the system 100. In the example of FIGS. 1C and 1D, the system 100 further includes a via fence 126. The via fence 126 includes a plurality of vias including the via 128. The via fence 126 is adjacent to the first conductive patch 120 and the second conductive patch 122. The via fence 126 is coupled to the waveguide 102. In a particular example, vias of the via fence 126 are maintained at a ground potential (e.g., where an exterior of the waveguide 102 and vias of the via fence 126 are connected to the ground plane 130 of FIG. 1A).

In some examples, the second conductive patch 122 is coupled to one or more vias of the via fence 126. In a particular example, the first conductive patch 120 is directly grounded against the waveguide 102 (e.g., by adjoining the wall 132 of the waveguide 102), and the second conductive patch 122 is indirectly grounded against the waveguide 102 (e.g., by the via fence 126).

During operation, the system 100 receives and transmits signals. To illustrate, referring again to FIG. 1A, the probe 106 is configured to receive a first signal 140 and to provide the first signal 140 to the half-patch launcher 104, such as by providing the first signal 140 to the second conductive patch 122. In some examples, the first signal 140 is an amplified signal that is received at the probe 106 from an amplifier that is coupled to the probe 106. In some examples, the first signal 140 is a differential signal, and the probe 106 includes coaxial wiring configured to provide the differential signal to the second conductive patch 122. In other implementations, the first signal 140 is a single-ended signal.

The half-patch launcher 104 is configured to generate a second signal 142 in response to the first signal 140. In some examples, the second signal 142 is generated via capacitive interaction of the first conductive patch 120 and the second conductive patch 122 responsive to the first signal 140. In some examples, the ground plane 130 is configured to generate a reflection of the second signal 142.

The waveguide 102 is configured to generate, based on the second signal 142, a transmission signal 144 that propagates in the waveguide 102. In a particular example, responsive to the first signal 140 provided to the second conductive patch 122 by the probe 106, interaction of the waveguide 102, the first conductive patch 120, and the second conductive patch 122 generates the transmission signal 144. In some implementations, the second conductive patch 122 increases bandwidth associated with the system 100, and the ground plane 130 functions as a reflector of the second signal 142 (e.g., where the ground plane 130 reflects a virtual image of the second signal 142). As a result, in some examples, a radiation pattern of the transmission signal 144 is based on (e.g., is the sum of) the second signal 142 and a reflection of the second signal 142 generated by the ground plane 130.

In some examples, the waveguide 102 is connected to one or more other devices (e.g., a receiver) configured to receive the transmission signal 144. In some examples, a height associated with the half-patch launcher 104 (e.g., a distance between the first conductive patch 120 and the second conductive patch 122) can be selected to determine (or affect) bandwidth of the system 100 available for the transmission signal 144.

One or more aspects of FIGS. 1A-1D improve operation or reduce size of a device as compared to certain conventional systems. In a particular example, the transmission signal 144 appears as a full copy of the first signal 140 instead of as half of the first signal 140 (e.g., due to the second conductive patch 122 increasing bandwidth of the system 100, due to the ground plane 130 functioning as a reflector of the second signal 142, due to grounding of the half-patch launcher 104 against the wall 132 of the waveguide 102, or a combination thereof). In some implementations, a single input signal 140 is provided to the half-patch launcher 104 via a single probe 106, which can reduce area of the system 100 and a number of components of the system 100 as compared to a device that provides a differential signal to a full-patch launcher via multiple probes. As a result, a number of size of components of the system 100 can be reduced. In some implementations, grounding of the half-patch launcher 104 against the wall 132 of the waveguide 102 can increase bandwidth of the system 100, provide a discharge path for electrostatic discharge (ESD) events, or both.

Although the examples described with reference to FIGS. 1A-1D illustrate a single half-patch launcher 104, in other implementations, a system includes multiple launchers. The multiple launchers can include the half-patch launcher 104 or other launchers. Certain examples of a system that can include multiple half-patch launchers are described further with reference to FIGS. 2A-2F.

Figure 2A:
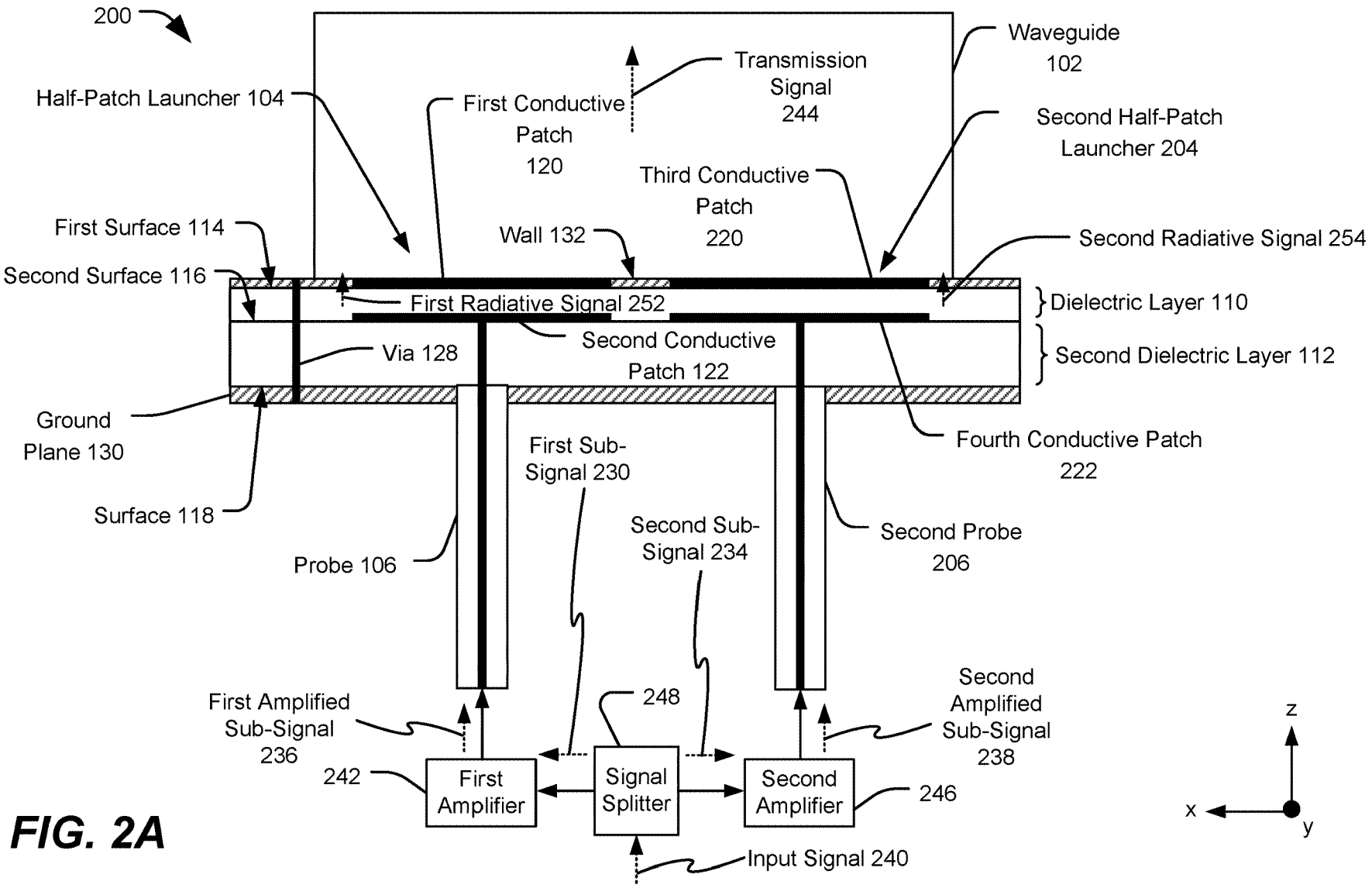
FIG. 2A is a diagram illustrating another example of a system in accordance with aspects of the disclosure.

Referring to FIG. 2A, a particular illustrative example of a system is depicted and generally designated 200. In some implementations, the system 200 includes one or more features described with reference to FIGS. 1A-1D. For example, in FIG. 2A, the system 200 includes the waveguide 102, the half-patch launcher 104, the dielectric layer 110, the second dielectric layer 112, the ground plane 130, one or more vias (such as representative via 128), and the probe 106. As with FIGS. 1A-1D, a single via 128 is illustrated in each of FIGS. 2A-2C for convenience of illustration; however, the system 200 can include a plurality of vias as illustrated in FIGS. 2D-2F.

The system 200 includes multiple launchers, such as a first launcher (e.g., the half-patch launcher 104) and a second launcher (e.g., a second half-patch launcher 204). In some examples, structure and operation of the second half-patch launcher 204 are as described with reference to the half-patch launcher 104. To illustrate, in the example of FIG. 2A, the second half-patch launcher 204 includes a third conductive patch 220 and a fourth conductive patch 222. The third conductive patch 220 is coupled to the first surface 114 of the dielectric layer 110. The fourth conductive patch 222 is coupled the second surface 116 of the dielectric layer 110. In some examples, the fourth conductive patch 222 is between the dielectric layer 110 and the second dielectric layer 112.

The system 200 further includes a second probe 206 coupled to the fourth conductive patch 222. The wall 132 of the waveguide 102 is conductively coupled to the third conductive patch 220 and the fourth conductive patch 222. In some examples, the third conductive patch 220 and the fourth conductive patch 222 are grounded against the waveguide 102. For example, in some implementations, the ground plane 130 is connected to the wall 132 of the waveguide 102, and the third conductive patch 220 and the fourth conductive patch 222 adjoin the wall 132. In some examples, the system 200 is mounted to a PCB or a PWB.

FIG. 2A also illustrates that the system 200 includes a first amplifier 242, a second amplifier 246, and a signal splitter 248. The first amplifier 242 is coupled to the probe 106, and the second amplifier 246 is coupled to second probe 206. The signal splitter 248 is coupled to the first amplifier 242 and to the second amplifier 246. In some implementations, the amplifiers 242, 246 include solid-state power amplifiers (SSPAs).

During operation, the signal splitter 248 is configured to receive an input signal 240 for transmission. In some examples, the input signal 240 corresponds to the first signal 140 of FIG. 1A. The signal splitter 248 is configured to split the input signal 240 to generate a two or more sub-signals, such as a first sub-signal 230 and a second sub-signal 234.

The first amplifier 242 is configured to amplify the first sub-signal 230 to generate a first amplified sub-signal 236. The second amplifier 246 is configured to amplify the second sub-signal 234 to generate a second amplified sub-signal 238.

In the example of FIG. 2A, the half-patch launcher 104 is configured to generate a first radiative signal 252 in response to the first amplified sub-signal 236. In some implementations, the first radiative signal 252 corresponds to the second signal 142 of FIG. 1A. The second half-patch launcher 204 is configured to generate a second radiative signal 254 in response to the second amplified sub-signal 238.

The half-patch launchers 104, 204 are coupled to the waveguide 102 such that the first radiative signal 252 and the second radiative signal 254 are combined in the waveguide to form a transmission signal 244 corresponding to the input signal 240. In some examples, the transmission signal 244 corresponds to the transmission signal 144 of FIG. 1A.

Figure 2B:
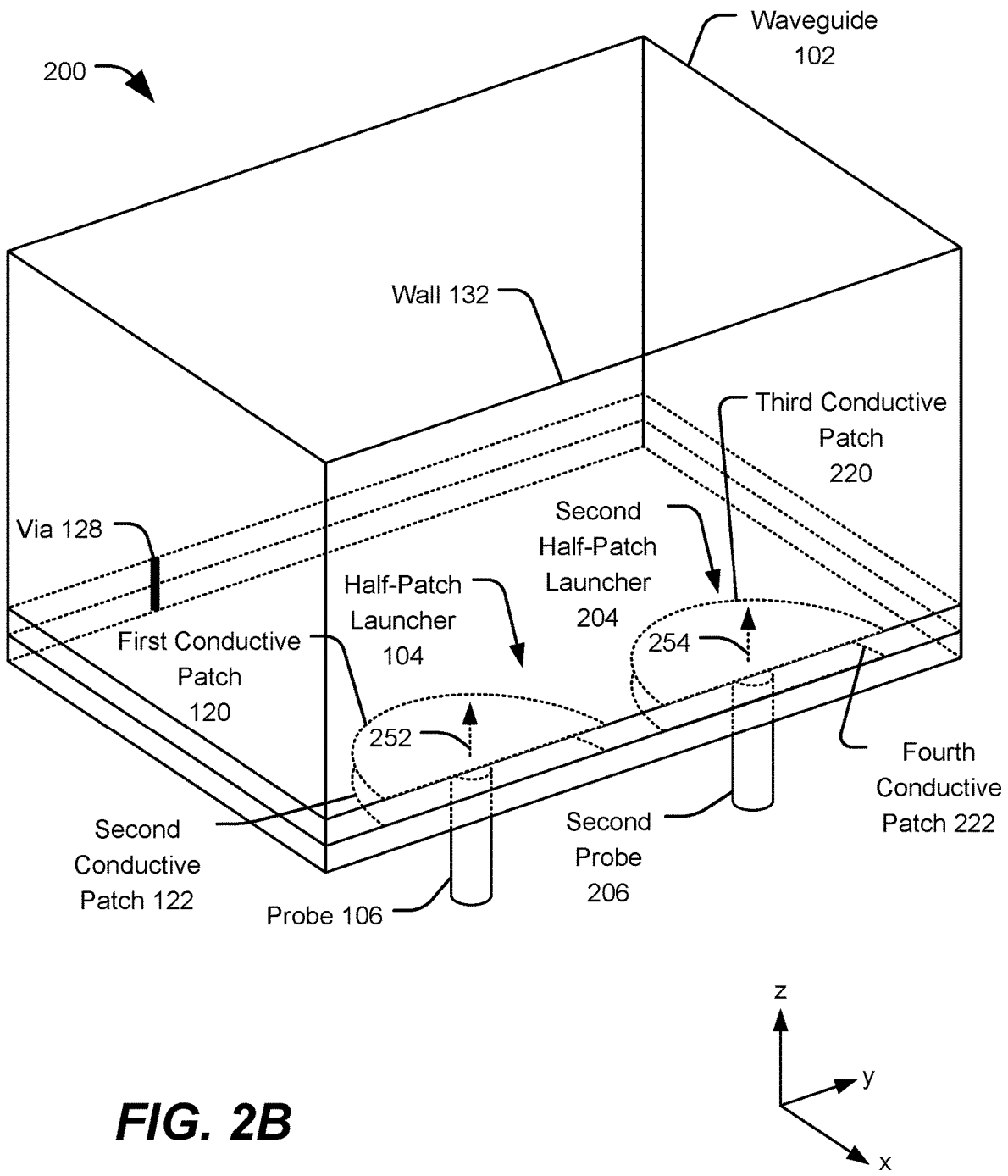
FIG. 2B is a diagram illustrating certain aspects of another example of the system of FIG. 2A.

To further illustrate, FIG. 2B depicts certain aspects of a particular example of the system 200. As illustrated in FIG. 2B, in some implementations, the half-patch launcher 104 and the second half-patch launcher 204 adjoin a particular wall of the waveguide 102. For example, in FIG. 2B, the half-patch launcher 104 and the second half-patch launcher 204 adjoin the wall 132 of the waveguide 102.

In the example of FIG. 2B, the first radiative signal 252 is in phase with the second radiative signal 254. For example, the signal splitter 248 of FIG. 2A can be configured to generate the sub-signals 230, 234 so that the first sub-signal 230 is in phase with the second sub-signal 234.

Figure 2C:
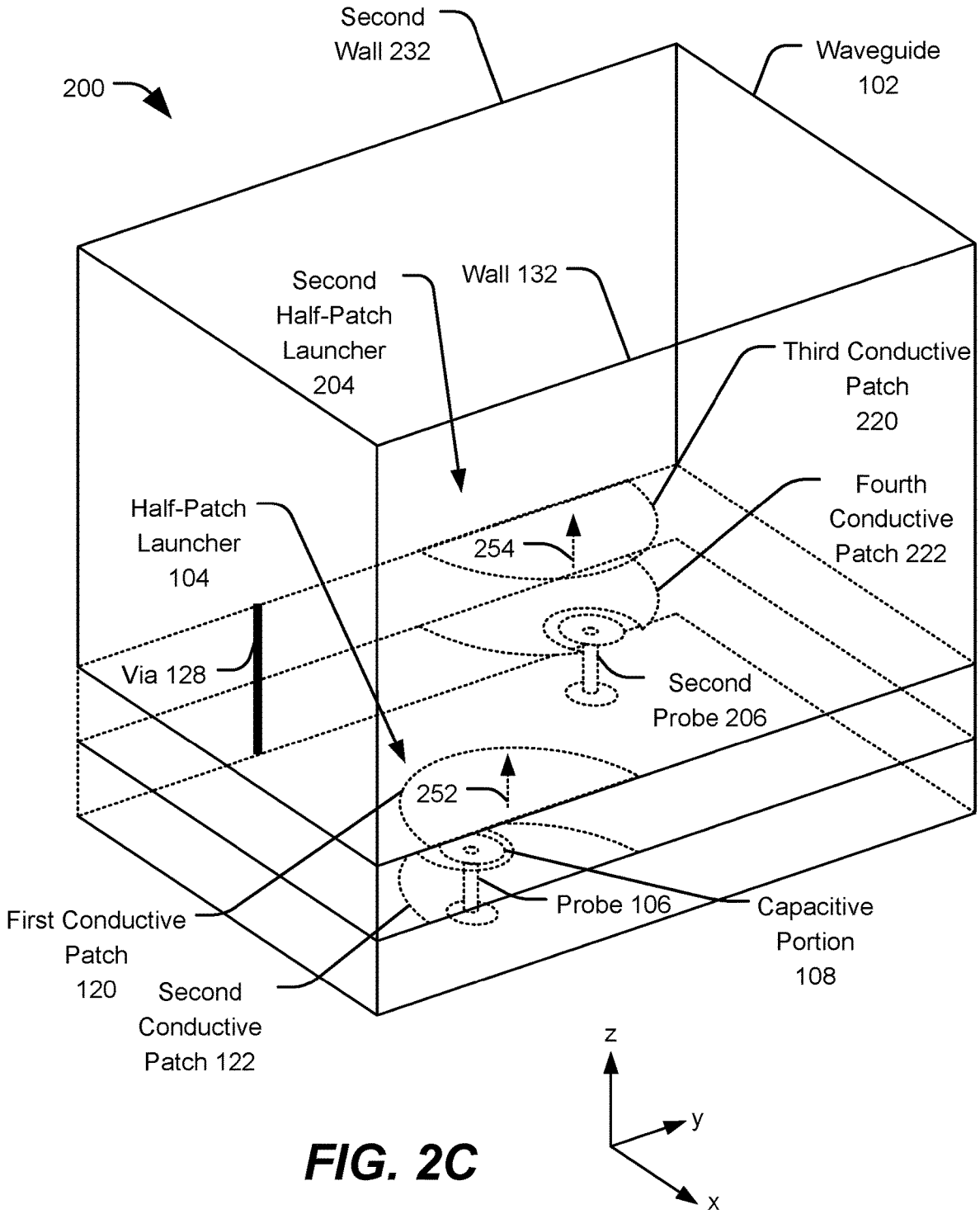
FIG. 2C is a diagram illustrating certain aspects of another example of the system of FIG. 2A.
Figure 2D:
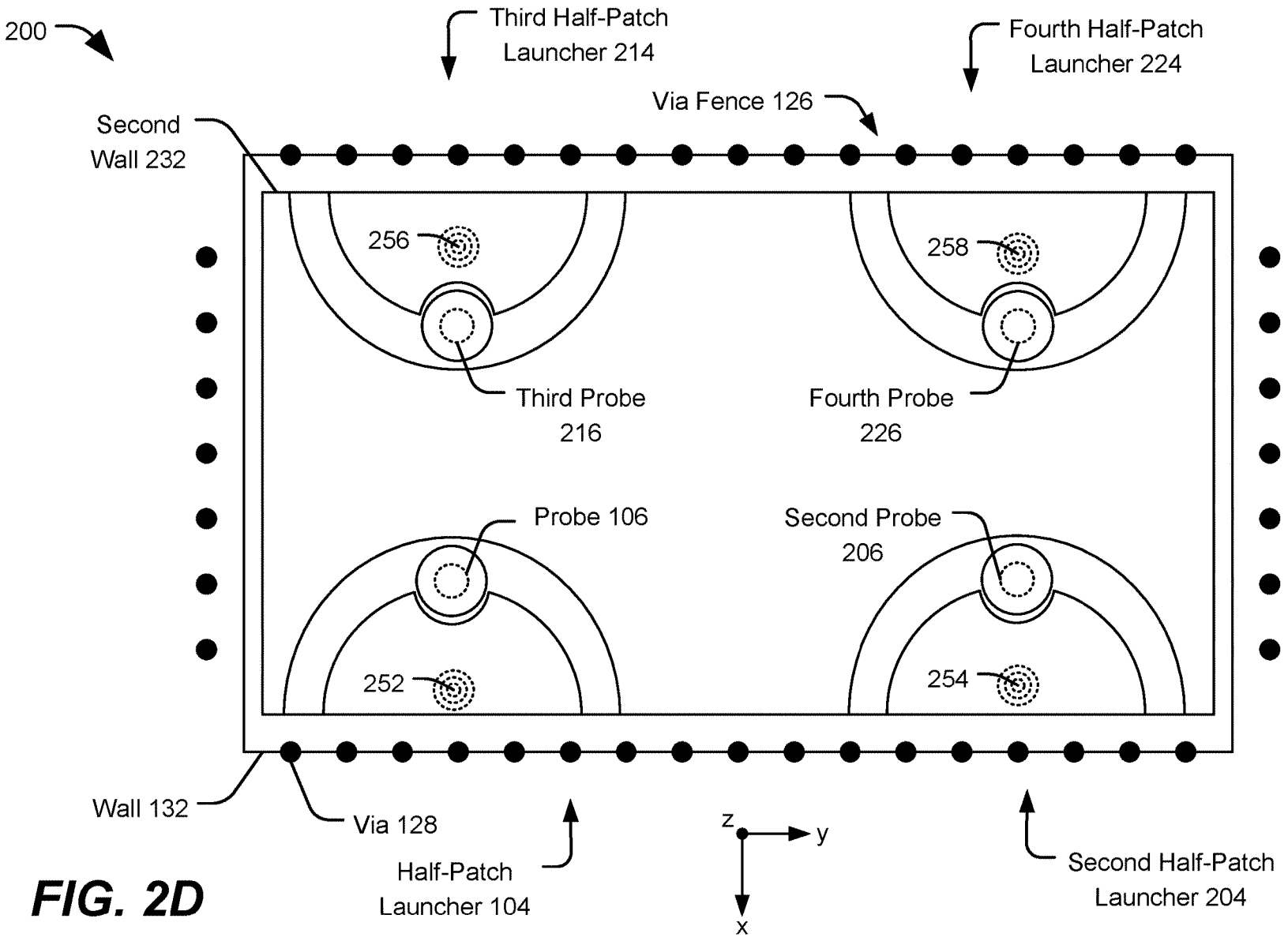
FIG. 2D is a diagram illustrating certain aspects of another example of the system of FIG. 2A.
Figure 2E:
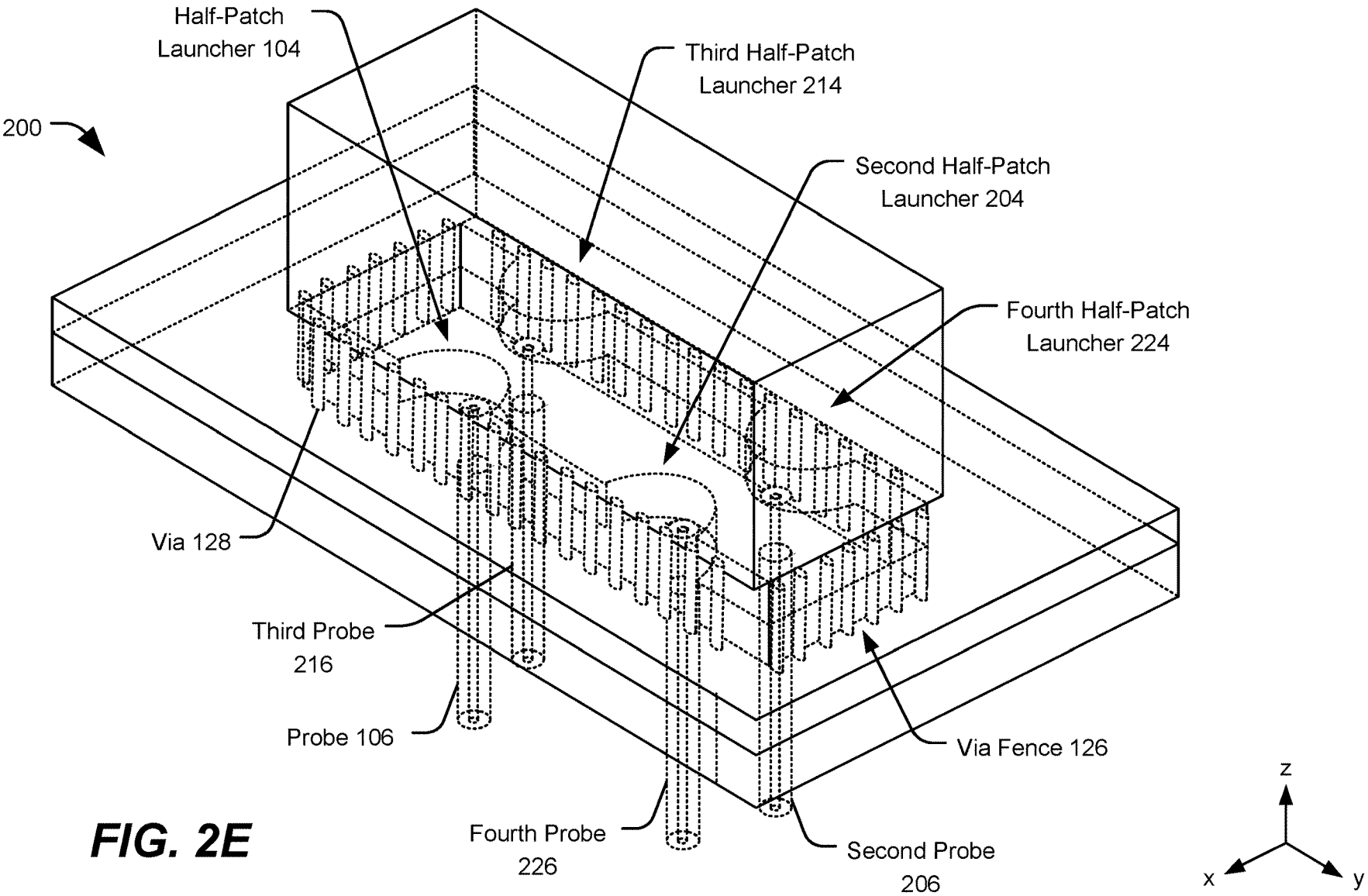
FIG. 2E is a diagram illustrating certain aspects of another example of the system of FIG. 2A.
Figure 2F:
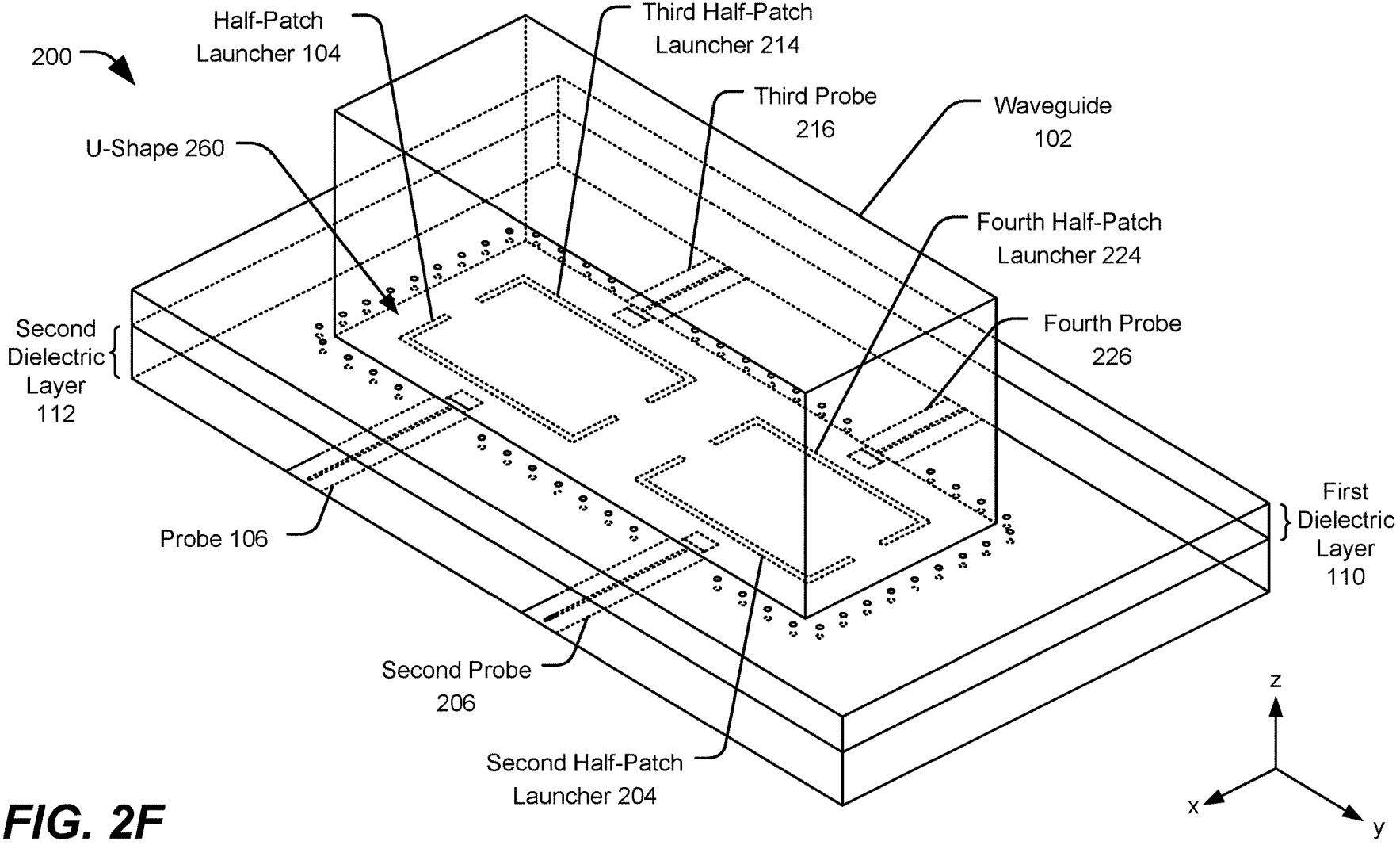
FIG. 2F is a diagram illustrating certain aspects of another example of the system of FIG. 2A.

FIG. 2C depicts certain aspects of another particular example of the system 200. As illustrated in FIG. 2C, in some implementations, the half-patch launcher 104 and the second half-patch launcher 204 adjoin different walls of the waveguide 102. For example, in FIG. 2C, the half-patch launcher 104 adjoins a first wall (e.g., the wall 132) of the waveguide 102, and the second half-patch launcher 204 adjoins a second wall 232 of the waveguide 102. The second wall 232 is opposite to the wall 132.

In the example of FIG. 2C, the first radiative signal is 180 degrees out of phase with the second radiative signal 254. In one example, the signal splitter 248 of FIG. 2A is configured to phase invert the first sub-signal 230 so that the first sub-signal 230 is 180 degrees out of phase with the second sub-signal 234. In some examples, the first sub-signal 230 and the first sub-signal 230 correspond to a differential signal.

In FIG. 2C, the probe 106 is capacitively coupled to the half-patch launcher 104 via the capacitive portion 108. FIG. 2C also depicts that the second probe 206 is capacitively coupled to the second half-patch launcher 204 (e.g., via a second capacitive portion). In certain other examples, one or more probes of the system 200 can be directly physically coupled to a corresponding launcher.

In some examples, the system 200 includes more than two launchers. For example, in FIGS. 2D and 2E, the system 200 further includes a third launcher (e.g., a third half-patch launcher 214) and a fourth launcher (e.g., a fourth half-patch launcher 224). In some examples, structure and operation of the third half-patch launcher 214 and the fourth half-patch launcher 224 correspond to the half-patch launcher 104. For example, in some implementations, the third half-patch launcher 214 and the fourth half-patch launcher 224 each include a first conductive patch corresponding to the first conductive patch 120 and a second conductive patch corresponding to the second conductive patch 122.

In some implementations, each of the half-patch launchers 104, 204, 214, and 224 is coupled to a respective probe. For example, FIGS. 2D and 2E depict that the half-patch launcher 104 is coupled to the probe 106 and that the second half-patch launcher 204 is coupled to the probe 206. FIGS. 2D and 2E also depict that the third half-patch launcher 214 is coupled to a third probe 216, and the fourth half-patch launcher 224 is coupled to a fourth probe 226. In some implementations, the half-patch launchers 104, 204, 214, and 224 correspond to a phased antenna array.

In a particular example, the third probe 216 is coupled to a third amplifier that is coupled to the signal splitter 248, and the fourth probe 226 is coupled to a fourth amplifier that is coupled to the signal splitter 248. In one example, the third amplifier is configured to generate a third amplified sub-signal corresponding to the input signal 240, and the fourth amplifier is configured to generate a fourth amplified sub-signal corresponding to the input signal 240.

In FIGS. 2D and 2E, the system 200 includes the via fence 126. In certain other examples, the via fence 126 can be omitted from the system 200.

FIG. 2D further illustrates that the third half-patch launcher 214 is configured to generate a third radiative signal 256 and that the fourth half-patch launcher 224 is configured to generate a fourth radiative signal 258. In the example of FIG. 2D, the radiative signals 252, 254, 256, and 258 propagate in the z direction. In a particular example, the waveguide 102 is configured to combine the first radiative signal 252, the second radiative signal 254, the third radiative signal 256, and the fourth radiative signal 258 to generate the transmission signal 244 of FIG. 2A.

In one example, the half-patch launcher 104 and the second half-patch launcher 204 adjoin a first wall of the waveguide 102 (e.g., the wall 132), as illustrated in FIG. 2D. The example of FIG. 2D further depicts that the third half-patch launcher 214 and the fourth half-patch launcher 224 adjoin a second wall of the waveguide (e.g., the second wall 232) that is opposite to the first wall. In a particular example, the first radiative signal 252 is 180 degrees out of phase with the fourth radiative signal 258, and the second radiative signal 254 is 180 degrees out of phase with the third radiative signal 256. In some examples, the first radiative signal 252 is in phase with the second radiative signal 254, and the third radiative signal 256 is in phase with the fourth radiative signal 258.

FIG. 2F illustrates certain aspects of another example of the system 200. In the example of FIG. 2F, each of the half-patch launchers 104, 204, 214, and 224 has a U-shape 260 (e.g., a half-square U-shape having a first side, a second side at a 90 degree angle to the first side, and a third side at a 90 degree angle to the second side). In one example, each of the half-patch launchers 104, 204, 214, and 224 includes a first conductive patch (e.g., the first conductive patch 120) having the U-shape 260 and further includes a second conductive patch (e.g., the second conductive patch 122) having the U-shape 260.

In the example of FIG. 2F, the probes 106, 206, 216, and 226 are oriented along the x direction (e.g., parallel to a major surface of the dielectric layers 110, 112). In other examples, the probes 106, 206, 216, and 226 are oriented along the z direction (e.g., so that the probes 106, 206, 216, and 226 extend perpendicularly with respect to the a major surface of the dielectric layers 110, 112, such as illustrated in the examples of FIGS. 1A-1D and 2A-2E).

Referring again to FIG. 2A, during operation, the system 200 is configured to coherently combine the radiative signals 252, 254 within the waveguide 102 to generate the transmission signal 244. Similarly, the system 200 illustrated in any of FIGS. 2B and 2C is configured to coherently combine the radiative signals 252, 254 within the waveguide 102 to generate the transmission signal 244. In a particular example, interaction of a plurality of launchers (e.g., the half-patch launchers 104, 204) with the waveguide 102 coherently combines the radiative signals 252, 254 in the waveguide 102 without use of a separate combiner circuit between the amplifiers 242, 246 and the waveguide 102.

Referring again to FIG. 2D, during operation, the system 200 is configured to coherently combine the radiative signals 252, 254, 256, and 258 within the waveguide 102 to generate the transmission signal 244. Similarly, the system 200 illustrated in any of FIGS. 2E and 2F is configured to coherently combine the radiative signals 252, 254, 256, and 258 within the waveguide 102 to generate the transmission signal 244. In a particular example, interaction of a plurality of launchers (e.g., the half-patch launchers 104, 204, 214, and 224) with the waveguide 102 coherently combines the radiative signals 252, 254, 256, and 258 in the waveguide 102 without use of a separate combiner circuit between a plurality of amplifiers and the waveguide 102.

One or more aspects of FIGS. 2A-2F improve operation or reduce size of a device as compared to certain conventional systems. For example, in some implementations, the waveguide 102 functions as a coherent combiner of the amplified sub-signals 236, 238, reducing or avoiding need for a separate combiner circuit between the amplifiers 242, 246 and the waveguide 102. In some cases, a loss characteristic associated with the waveguide 102 may be less than a loss characteristic associated with a combiner circuit. As a result, efficiency is increased by using the waveguide 102 as a medium for coherent spatial combining of signals. Further, circuit area can be decreased by reducing or avoiding use of combiner circuits, decreasing size of the system 200 or increasing area of the system 200 available to other components.

Figure 3:
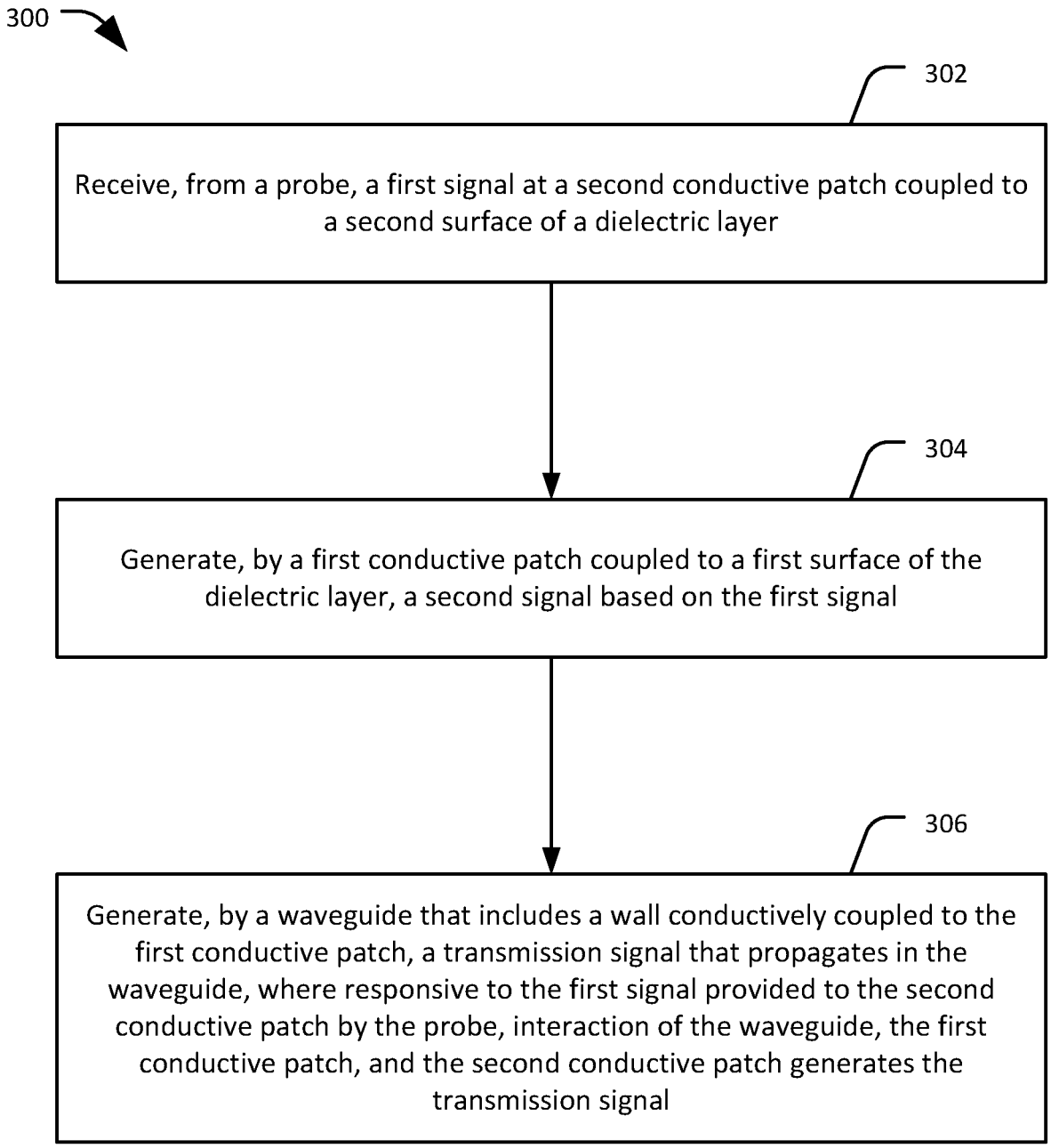
FIG. 3 is a flow chart of an example of a method of operation of the system of any of FIGS. 1A-1D.

Referring to FIG. 3, a particular illustrative example of a method is depicted and generally designated 300. In some examples, the method 300 is performed by the system 100 of any of FIGS. 1A-1D. Alternatively or in addition, in some examples, the method 300 is performed by any of the half-patch launchers 104, 204, 214, and 216 described with reference to FIGS. 2A-2F.

The method 300 includes receiving, from a probe, a first signal at a second conductive patch coupled to a second surface of a dielectric layer, at 302. In one example, the second conductive patch 122 is configured to receive the first signal 140 from the probe 106. The second conductive patch 122 is coupled to the second surface 116 of the dielectric layer 110.

The method 300 further includes generating, by a first conductive patch coupled to a first surface of the dielectric layer, a second signal based on the first signal, at 304. In a particular example, the first conductive patch 120 is configured to generate the second signal 142 based on the first signal 140. The first conductive patch 120 is coupled to the first surface 114 of the dielectric layer 110.

The method 300 further includes generating, by a waveguide that includes a wall conductively coupled to the first conductive patch, a transmission signal that propagates in the waveguide, at 306. Responsive to the first signal provided to the second conductive patch by the probe, interaction of the waveguide, the first conductive patch, and the second conductive patch generates the transmission signal. To illustrate, in one example, the waveguide 102 includes the wall 132 conductively coupled to the first conductive patch 120 and is configured to generate the transmission signal 144. In a particular example, interaction of the waveguide 102, the first conductive patch 120, and the second conductive patch 122 generates the transmission signal 144 responsive to the first signal 140 provided to the second conductive patch 122 by the probe 106.

In some examples of the method 300, the first signal 140 is received at the second conductive patch 122 via capacitive coupling of the second conductive patch 122 and the probe 106. To illustrate, in some implementations, the second conductive patch 122 is capacitively coupled to the probe 106 via the capacitive portion 108. In some examples of the method 300, the second signal 142 is generated at the first conductive patch 120 via capacitive coupling of the first conductive patch 120 and the second conductive patch 122 responsive to the first signal 140.

One or more aspects of the method 300 of FIG. 3 improve operation or reduce size of a device as compared to certain conventional systems. In a particular example, a transmission signal appears as a full copy of an input signal instead of as half of the input signal (e.g., due to the second conductive patch 122 increasing bandwidth of the system 100, due to the ground plane 130 functioning as a reflector of the second signal 142, due to grounding of the half-patch launcher 104 against the wall 132 of the waveguide 102, or a combination thereof). In some implementations, a single input signal is provided to a half-patch launcher via a single probe, which can reduce area of a system and a number of components of the system as compared to a device that provides a differential signal to a full-patch launcher via two probes. As a result, a number of size of components of the system can be reduced.

Figure 4:
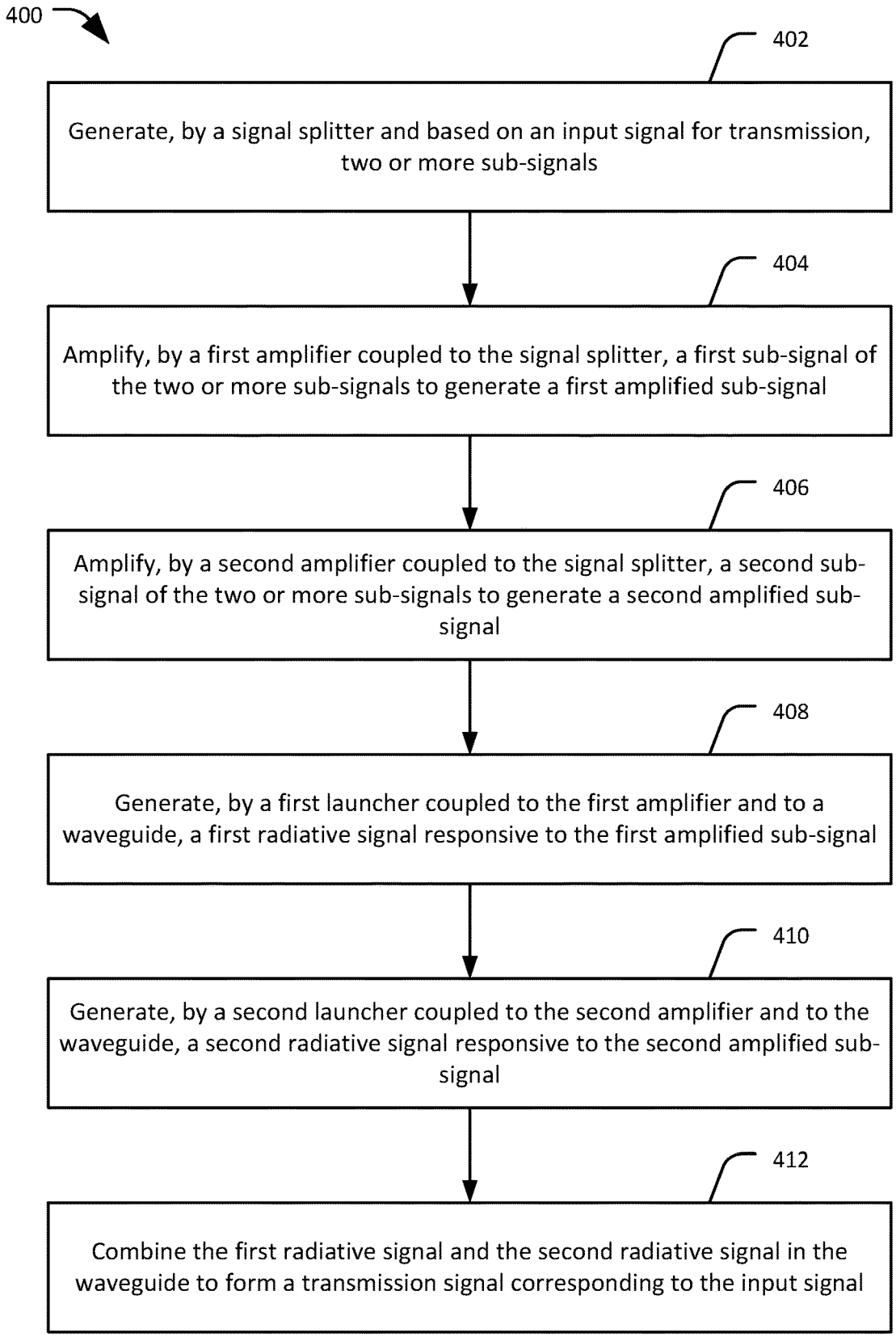
FIG. 4 is a flow chart of an example of a method of operation of the system of any of FIGS. 2A-2F.

Referring to FIG. 4, a particular illustrative example of a method is depicted and generally designated 400. In some examples, the method 400 is performed by the system 200 of any of FIGS. 2A-2F.

The method 400 includes generating, by a signal splitter and based on an input signal for transmission, two or more sub-signals, at 402. To illustrate, in one example, the signal splitter 248 is configured to generate, based on the input signal 240, two or more sub-signals, such as the first sub-signal 230 and the second sub-signal 234.

The method 400 further includes amplifying, by a first amplifier coupled to the signal splitter, a first sub-signal of the two or more sub-signals to generate a first amplified sub-signal, at 404. In one example, the first amplifier 242 is configured to amplify the first sub-signal 230 to generate the first amplified sub-signal 236.

The method 400 further includes amplifying, by a second amplifier coupled to the signal splitter, a second sub-signal of the two or more sub-signals to generate a second amplified sub-signal, at 406. In one example, the second amplifier 246 is configured to amplify the second sub-signal 234 to generate the second amplified sub-signal 238.

The method 400 further includes generating, by a first launcher coupled to the first amplifier and to a waveguide, a first radiative signal responsive to the first amplified sub-signal, at 408. In one example, the half-patch launcher 104 is configured to generate the first radiative signal 252 responsive to the first amplified sub-signal 236.

The method 400 further includes generating, by a second launcher coupled to the second amplifier and to the waveguide, a second radiative signal responsive to the second amplified sub-signal, at 410. In one example, the second half-patch launcher 204 is configured to generate the second radiative signal 254 responsive to the second amplified sub-signal 238.

The method 400 further includes combining the first radiative signal and the second radiative signal in the waveguide to form a transmission signal corresponding to the input signal, at 412. In a particular example, the waveguide 102 is configured to combine the first radiative signal 252 and the second radiative signal 254 to generate the transmission signal 244.

One or more aspects of the method 400 of FIG. 4 improve operation or reduce size of a device as compared to certain conventional systems. For example, in some implementations, a waveguide functions as a coherent combiner of amplified signals, reducing or avoiding need for a separate combiner circuit. In some cases, a loss characteristic associated with the waveguide may be less than a loss characteristic associated with a combiner circuit. As a result, efficiency is increased by using the waveguide as a medium for coherent spatial combining of signals. Further, circuit area can be decreased by reducing or avoiding use of combiner circuits, decreasing size of a system or increasing area of the system available to other components.

Figure 5:
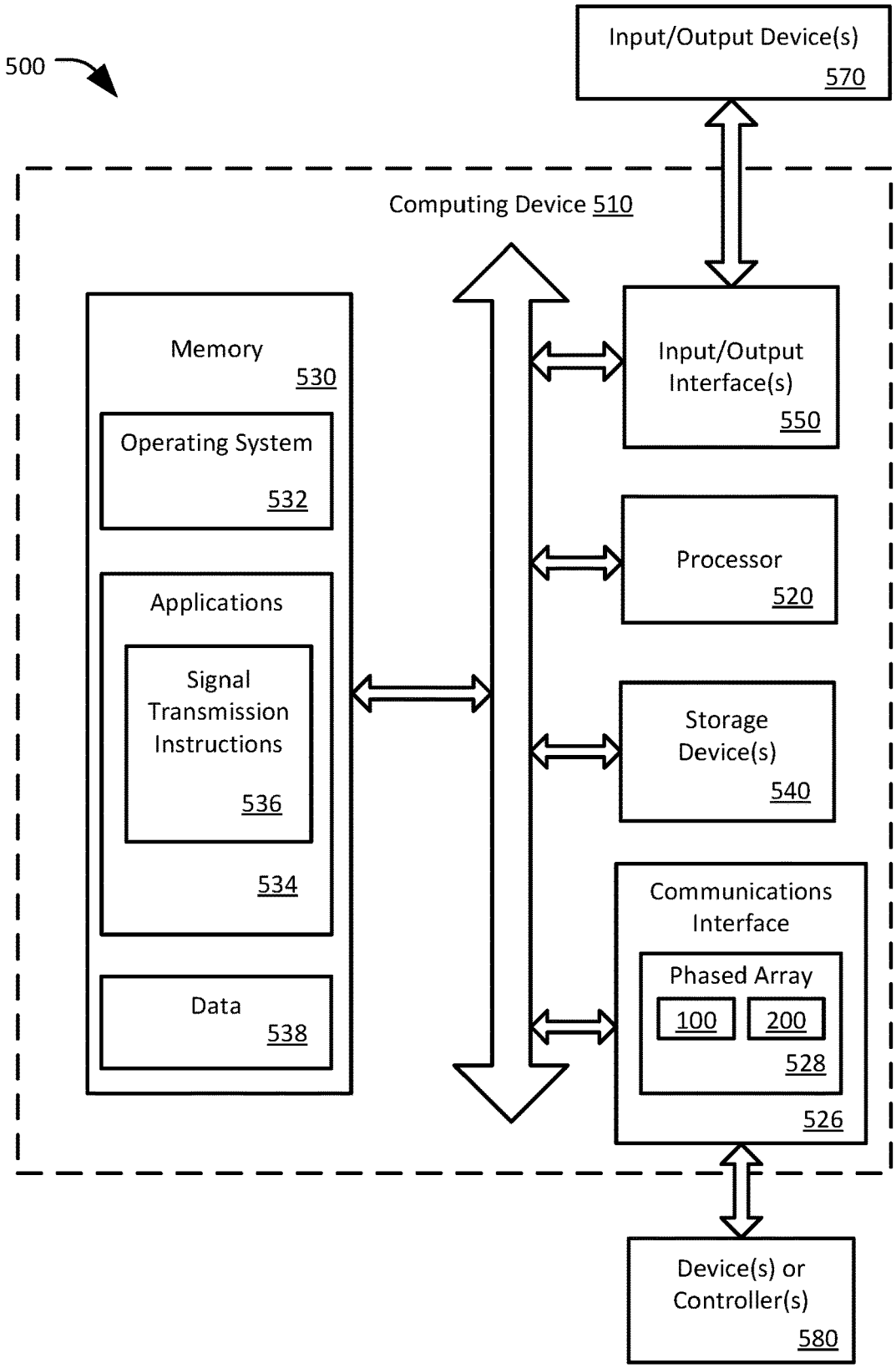
FIG. 5 is a block diagram illustrating aspects of an example of a computing system that is configured to execute instructions to initiate, perform, or control operations, such as operations of the method of FIG. 3, operations of the method of FIG. 4, or a combination thereof.

FIG. 5 is an illustration of a block diagram of a computing environment 500 including a computing device 510. The computing device 510 is configured to support embodiments of computer-implemented methods and computer-executable program instructions (or code) according to the disclosure. In some examples, the computing device 510, or portions thereof, is configured to execute instructions to initiate, perform, or control operations described herein, such as operations of the method 300 of FIG. 3, operations of the method 400 of FIG. 4, or both. In some implementations, the computing device 510 is integrated within a vehicle, such as an aircraft, a space vehicle, or a ground vehicle, as illustrative examples.

The computing device 510 includes a processor 520. The processor 520 is configured to communicate with a memory 530 (e.g., a system memory or another memory), one or more storage devices 540, one or more input/output interfaces 550, a communications interface 526, or a combination thereof.

Depending on the particular implementation, the memory 530 includes volatile memory devices (e.g., volatile random access memory (RAM) devices), nonvolatile memory devices (e.g., read-only memory (ROM) devices, programmable read-only memory, or flash memory), one or more other memory devices, or a combination thereof. In FIG. 5, the memory 530 stores an operating system 532, which can include a basic input/output system for booting the computing device 510 as well as a full operating system to enable the computing device 510 to interact with users, other programs, and other devices. The example of FIG. 5 also depicts that the memory 530 stores one or more applications 534 executable by the processor 520. In some examples, the one or more applications 534 include instructions executable by the processor 520 to transmit data or signals between components of the computing device 510, such as the memory 530, the one or more storage devices 540, the one or more input/output interfaces 550, the communications interface 526, or a combination thereof.

In the example of FIG. 5, the one or more applications 534 include signal transmission instructions 536. In a particular example, the computing device 510 is configured to execute the signal transmission instructions 536 to initiate, control, or perform one or more operations described herein, such as one or more operations of the method 300 of FIG. 3, one or more operations of the method 400 of FIG. 4, or a combination thereof. In a particular illustrative example, the processor 520 is configured to execute the signal transmission instructions 536 to send the first signal 140 to the system 100 for transmission as the transmission signal 144. Alternatively or in addition, in another example, the processor 520 is configured to execute the signal transmission instructions 536 to send the input signal 240 to the system 200 for transmission as the transmission signal 244. In some examples, one or both of the first signal 140 or the input signal 240 include data 538 (or a representation of the data 538, such as an analog version of the data 538) that is generated by the processor 520, stored at the memory 530, or both.

In some implementations, one or more storage devices 540 include nonvolatile storage devices, such as magnetic disks, optical disks, or flash memory devices. In some examples, the one or more storage devices 540 include removable memory devices, non-removable memory devices or both. In some cases, the one or more storage devices 540 are configured to store an operating system, images of operating systems, applications, and program data. In a particular example, the memory 530, the one or more storage devices 540, or both, include tangible computer-readable media.

In the example of FIG. 5, the processor 520 is configured to communicate with the one or more input/output interfaces 550 to enable the computing device 510 to communicate with one or more input/output devices 570 to facilitate user interaction. In some implementations, the one or more input/output interfaces 550 include one or more serial interfaces (e.g., universal serial bus (USB) interfaces or Institute of Electrical and Electronics Engineers (IEEE) 1394 interfaces), parallel interfaces, display adapters, audio adapters, one or more other interfaces, or a combination thereof (IEEE is a registered trademark of The Institute of Electrical and Electronics Engineers, Inc. of Piscataway, N.J.). In some examples, the one or more input/output devices 570 include keyboards, pointing devices, displays, speakers, microphones, touch screens, one or more other devices, or a combination thereof. In some examples, the processor 520 is configured to detect interaction events based on user input received via the one or more input/output interfaces 550. Alternatively or in addition, in some implementations, the processor 520 is configured to send information to a display via the one or more input/output interfaces 550.

In a particular example, the processor 520 is configured to communicate with (e.g., send signals to) one or more devices 580 using the communications interface 526. In some implementations, the communications interface 526 includes one or more wired interfaces (e.g., Ethernet interfaces), one or more wireless interfaces that comply with an IEEE 802.11 communication protocol, one or more other wireless interfaces, one or more optical interfaces, or one or more other network interfaces, or a combination thereof. In some examples, the one or more devices 580 include host computers, servers, workstations, one or more other computing devices, or a combination thereof. In some examples, the processor 520 is configured to send the data 538 to the one or more devices 580 using the system 100, the system 200, or both.

In some examples, the communications interface 526 includes the system 100, the system 200, or both. To illustrate, in the example of FIG. 5, the communications interface 526 includes a phased array 528 that includes the system 100, the system 200, or both. In a particular example, the phased array 528 includes a plurality of launchers including any of the half-patch launchers 104, 204, 214, and 224. In some implementations, the processor 520 is configured to execute the signal transmission instructions 536 to steer a transmission signal (e.g., the transmission signal 244) generated by the plurality of launchers of the phased array 528.

Although the phased array 528 is described with reference to the computing device 510, in other implementations, the phased array 528 can be utilized in another application. For example, in some implementations, the phased array 528 is used in a broadcasting device, a radar device, a space communications device, a weather research device, an optical device, a satellite broadband Internet transceiver, a radio frequency identification (RFID) device, or a human-machine interface, as illustrative examples. Further, it is noted that in some implementations, one or both of the system 100 or the system 200 are integrated within a satellite device. As a particular illustrative example, in some implementations, the phased array 528 and the processor 520 are integrated within a satellite, and the processor 520 is configured to execute the signal transmission instructions 536 to steer a transmission signal (e.g., the transmission signal 244) toward a receiver (e.g., a ground-based receiver) based on on the particular location and orientation of the satellite.

Figure 6:
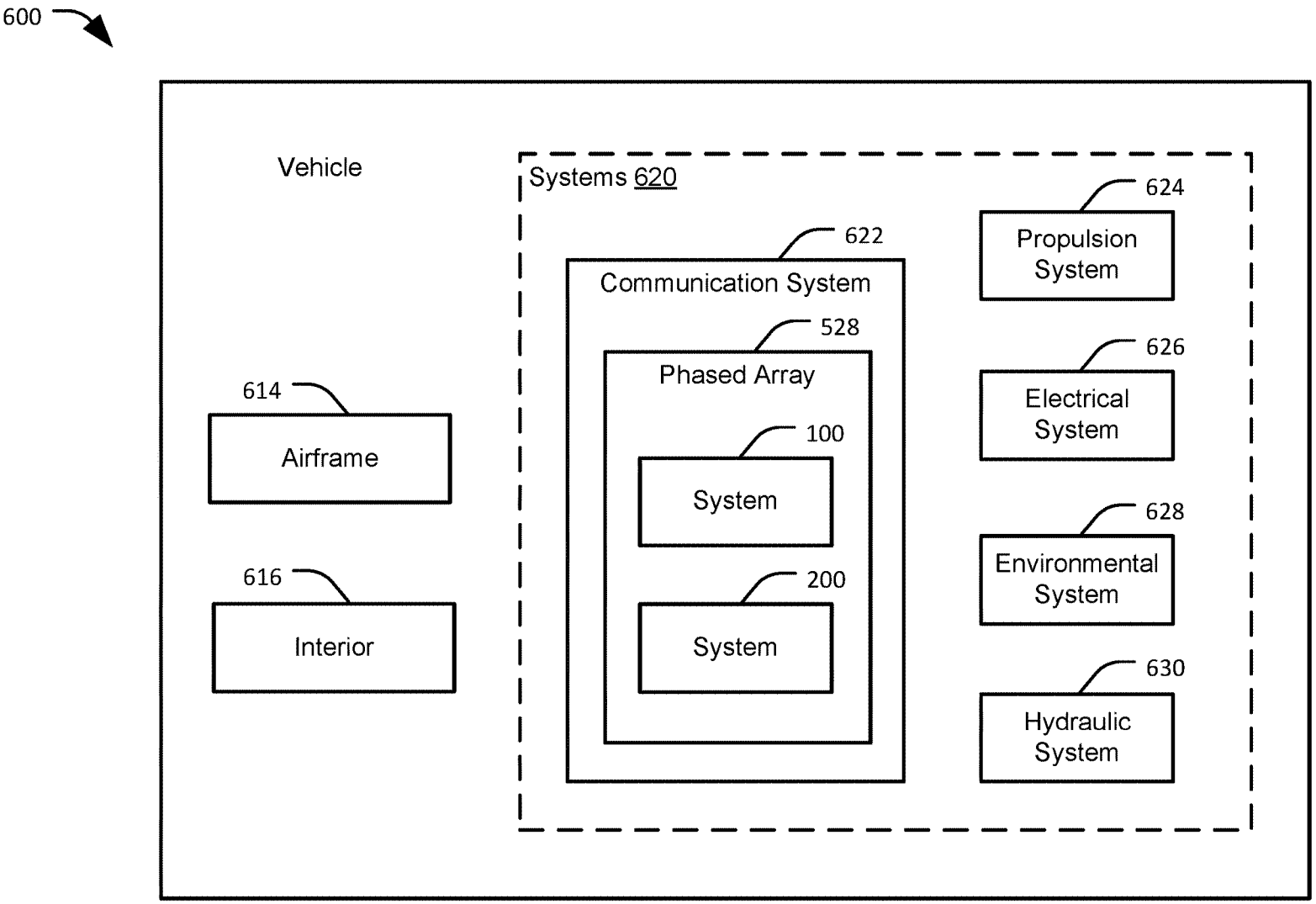
FIG. 6 is a block diagram illustrating aspects of an illustrative implementation of a vehicle that includes the system of any of FIGS. 1A-1D, the system of any of FIGS. 2A-2F, or a combination thereof.

Aspects of the disclosure may be described in the context of an example of a vehicle, such as a vehicle 600 as shown in the example of FIG. 6. In some implementations, the vehicle 600 corresponds to an aircraft, a space vehicle, a ground vehicle, or another vehicle, as illustrative examples.

As shown in FIG. 6, the vehicle 600 includes an airframe 614 with an interior 616 and a plurality of systems 620. Examples of the plurality of systems 620 include one or more of a communication system 622, a propulsion system 624, an electrical system 626, an environmental system 628, and a hydraulic system 630. In the example of FIG. 6, the communication system 622 includes the system 100 of any of FIGS. 1A-1D, the system 200 of any of FIGS. 2A-2F, or a combination thereof. In some implementations, the communication system 622 includes the phased array 528, and the phased array 528 includes the system 100, the system 200, or both. In some examples, one or more aspects of the vehicle 600 (e.g., the communication system 622) are implemented within a satellite.

The illustrations of the examples described herein are intended to provide a general understanding of the structure of the various implementations. The illustrations are not intended to serve as a complete description of all of the elements and features of apparatuses and systems that utilize the structures or methods described herein. Many other implementations may be apparent to those of skill in the art upon reviewing the disclosure. Other implementations may be utilized and derived from the disclosure, such that structural and logical substitutions and changes may be made without departing from the scope of the disclosure. For example, method operations may be performed in a different order than shown in the figures or one or more method operations may be omitted. Accordingly, the disclosure and the figures are to be regarded as illustrative rather than restrictive.

Moreover, although specific examples have been illustrated and described herein, it should be appreciated that any subsequent arrangement designed to achieve the same or similar results may be substituted for the specific implementations shown. This disclosure is intended to cover any and all subsequent adaptations or variations of various implementations. Combinations of the above implementations, and other implementations not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single implementation for the purpose of streamlining the disclosure. Examples described above illustrate, but do not limit, the disclosure. It should also be understood that numerous modifications and variations are possible in accordance with the principles of the present disclosure. As the following claims reflect, the claimed subject matter may be directed to less than all of the features of any of the disclosed examples. Accordingly, the scope of the disclosure is defined by the following claims and their equivalents.

What is claimed is:

1. An apparatus comprising:

a first conductive patch coupled to a first surface of a dielectric layer;

a second conductive patch coupled to a second surface of the dielectric layer;

a probe coupled to the second conductive patch; and a waveguide including a wall conductively coupled to the first conductive patch, wherein the first conductive patch and the second conductive patch are grounded against the waveguide, and wherein in response to a signal provided to the second conductive patch by the probe, interaction of the waveguide, the first conductive patch, and the second conductive patch generates a transmission signal that propagates in the waveguide.

2. The apparatus of claim 1, further comprising a second dielectric layer, wherein the second conductive patch is between the dielectric layer and the second dielectric layer.

3. The apparatus of claim 2, further comprising a ground plane coupled to a surface of the second dielectric layer.

4. The apparatus of claim 1, wherein the first conductive patch adjoins the wall.

5. The apparatus of claim 1, wherein a half-patch launcher comprises the first conductive patch and the second conductive patch.

6. The apparatus of claim 5, wherein the half-patch launcher has a semicircle shape.

7. The apparatus of claim 5, wherein the half-patch launcher has a U-shape.

8. The apparatus of claim 5, wherein the half-patch launcher comprises a capacitive portion.

9. The apparatus of claim 8, wherein the probe is associated with an inductance, and wherein the capacitive portion is configured to reduce an effect of the inductance associated with the probe.

10. The apparatus of claim 1, wherein the waveguide has a rectangular shape.

11. The apparatus of claim 1, further comprising a via fence adjacent to the first conductive patch and the second conductive patch and coupled to the waveguide.

12. A method comprising:

receiving, from a probe, a first signal at a second conductive patch coupled to a second surface of a dielectric layer;

generating, by a first conductive patch coupled to a first surface of the dielectric layer, a second signal based on the first signal; and generating, by a waveguide that includes a wall conductively coupled to the first conductive patch, a transmission signal that propagates in the waveguide, wherein the first signal is received at the second conductive patch via capacitive coupling of the second conductive patch and the probe, and wherein in response to the first signal provided to the second conductive patch by the probe, interaction of the waveguide, the first conductive patch, and the second conductive patch generates the transmission signal.

13. The method of claim 12, wherein a half-patch launcher comprises the first conductive patch and the second conductive patch.

14. The method of claim 12, wherein the first conductive patch and the second conductive patch are grounded against the waveguide.

15. The method of claim 12, wherein the second signal is generated at the first conductive patch via capacitive coupling of the first conductive patch and the second conductive patch in response to the first signal.

16. An apparatus comprising:

a half-patch launcher including a first conductive patch coupled to a first surface of a dielectric layer and further including a second conductive patch coupled to a second surface of the dielectric layer;

a via fence adjacent to the first conductive patch and the second conductive patch and coupled to a waveguide; and a probe coupled to the second conductive patch, wherein the waveguide includes a wall conductively coupled to the first conductive patch, and wherein in response to a signal provided to the second conductive patch by the probe, interaction of the waveguide, the first conductive patch, and the second conductive patch generates a transmission signal that propagates in the waveguide.

17. The apparatus of claim 16, further comprising a second dielectric layer, wherein the second conductive patch is between the dielectric layer and the second dielectric layer.

18. The apparatus of claim 17, further comprising a ground plane coupled to a surface of the second dielectric layer.

19. The apparatus of claim 16, wherein the half-patch launcher has a semicircle shape or a U-shape.

20. The apparatus of claim 16, wherein the waveguide has a rectangular shape.

* * * * *